United States Patent [19]

Kime

[11] Patent Number: 4,707,993

[45] Date of Patent: Nov. 24, 1987

[54] PUMPING APPARATUS

[75] Inventor: James A. Kime, Columbus, Ohio

[73] Assignee: Hydro-Horse, Inc., Columbus, Ohio

[21] Appl. No.: 209,391

[22] Filed: Nov. 24, 1980

[51] Int. Cl.[4] ..... F16D 31/02; F16H 39/46

[52] U.S. Cl. ..... 60/372; 60/381; 60/414

[58] Field of Search ..... 417/217, 218, 222, 542, 417/401; 60/414, 381, 444, 465, 372

[56] References Cited

U.S. PATENT DOCUMENTS

| | | | |
|---|---|---|---|
| 2,560,676 | 7/1951 | White | 60/51 |
| 2,564,285 | 8/1951 | Smith | 60/51 |
| 3,632,234 | 1/1972 | Lake | 417/390 |
| 3,939,656 | 2/1976 | Goldfein | 60/381 |
| 4,047,384 | 9/1977 | Saruwatari | 60/372 |
| 4,077,744 | 3/1978 | Pensa | 417/218 |
| 4,114,375 | 9/1978 | Saruwatari | 60/372 |
| 4,188,787 | 2/1980 | Bromell et al. | 417/217 X |

OTHER PUBLICATIONS

Econo-Pump Corporation brochure.
Marine and Petroleum Equipment brochure.
HOE Pump brochure.
Hydra-Carbon Mechanicals brochure.
Pearson Hydraulic brochure (Hydrax).

*Primary Examiner*—Edward K. Look

*Attorney, Agent, or Firm*—Emch, Schaffer, Schaub & Porcello Co.

[57] ABSTRACT

A pumping apparatus is disclosed which uses a reversible, variable displacement hydraulic drive pump capable of pumping fluid under pressure. A hydraulic cylinder enclosing a piston is operatively connected to a port of the hydraulic drive pump. A fluid accumulator, which is precharged to a selected precharge pressure, is operatively connected to the other port of the hydraulic drive pump. The fluid accumulator supplies the fluid under the precharge pressure to the hydraulic drive pump. The hydraulic drive pump increases the pressure on the fluid to a working pressure required to drive the piston from a first position in a first direction to a second predetermined position. Upon reaching the second position, the hydraulic drive pump reverses direction to reverse the flow of fluid from the hydraulic cylinder thereby reciprocating the piston back to its first position, and directing the fluid to the fluid accumulator. Inertial forces on the piston surface area pressurize the reversed fluid to a first inertial pressure. The hydraulic drive pump increases the pressure on the fluid moving from the hydraulic cylinder toward the accumulator to a second pressure greater than the inertial pressure, and directs the fluid under the second pressure into the precharged fluid accumulator. Makeup or relief means in the apparatus maintain the second pressure equal to the selected charge pressure.

12 Claims, 4 Drawing Figures

PUMPING APPARATUS

BACKGROUND OF THE INVENTION

The invention is a pumping apparatus which is an energy recovering hydraulic system, capable of an infinite variety of adjustments to meet optimum pumping efficiency necessary to operate a specific well.

The most typical prior art apparatus used to pump fluids, such as oil, is a conventional pumping unit or jack which comprises a gear driven beam or crank, counterbalanced by individual weights. The counterweights are intended to counterbalance the forces directed to the pumping unit from the well.

The heart of the conventional counterweighted pumping unit is the main gear used to drive the beam or crank. Frequently field conditions make it difficult to provide adequate maintenance to the pumping unit. If there is a lack of servicing, the main gear commonly fails, requiring expensive and frequent overhauling of the pumping unit.

Furthermore, the conventional pumping unit is generally expensive to purchase and cumbersome to set up and install. Because the unit must be installed in a proximate position to the well-head, it is reliant on the structure of the surrounding ground for its support, thereby necessitating the installation of a pad to provide the necessary stability. Complete installation of the conventional pumping unit frequently requires the use of a pole truck, servicing rig and many expensive man-hours.

Another known pumping apparatus is the natural gas pumper. This type of pumping apparatus uses the natural gas pressure from the well to assist in operating the pumper. This mode of pumping apparatus cannot operate if the given well is low on gas pressure.

There are other known hydraulic pumping apparatus currently in use. However, these units generally require a service rig or pole truck to install and maintain. The known hydraulic pumpers generally dissipate the energy needed to operate the hydraulic cylinder and do not operate in an energy recovering mode. Many of these pumpers further use a fixed displacement pump, thereby eliminating the ability to adjust the pumping speed in an energy efficient manner.

The pumping apparatus of the present invention eliminates many of the above-mentioned problems by use of a fully adjustable energy recovering hydraulic system to be described fully in the specification below.

SUMMARY OF THE INVENTION

The pumping apparatus of the present invention utilizes at least one hydraulic cylinder enclosing a piston, which is fixed directly to the well-head, thereby eliminating installation problems due to uneven or unstable terrain. The operating unit comprising a reversible, variable displacement hydraulic pump, drive motor, reservoir, and fluid accumulator is attached to the hydraulic pumping cylinder by flexible hydraulic lines. Therefore the operating unit may be placed in any position proximate to the well-head and need not be placed in any particular location.

The pumping apparatus of the present invention uses a reversible variable displacement hydraulic drive pump capable of pumping a fluid under high pressure. A fluid accumulator, precharged to a selected charge pressure, supplies fluid under high pressure to the hydraulic drive pump. The hydraulic drive pump increases the pressure of the charged fluid and directs the fluid to the hydraulic cylinder. The hydraulic cylinder, being mounted on the well-head, is operatively connected to the polish rod portion of the sucker rod apparatus. The inertial weight of the sucker rod apparatus and column of crude oil being pumped is directed to the piston of the hydraulic cylinder. As the hydraulic drive pump directs the charged fluid from the fluid accumulator to the hydraulic cylinder, it increases the pressure of the charged fluid to a pressure required to work against the surface area of the piston in the hydraulic cylinder to overcome the inertial forces from the well and drive the piston from a first position in a first direction to a second predetermined position. The driven piston thereby moves the polish rod from a first position in a first direction to a second position, causing the sucker rod to operate the fluid pump contained within the well and pump the fluid. When the piston reaches the predetermined position, the hydraulic drive pump reverses the flow of fluid from the hydraulic cylinder thereby reciprocating the piston back to its first position, and directing the fluid to the fluid accumulator. The inertial forces exerted on the piston surface area by the sucker rod apparatus and column of fluid pressurize the reversed fluid to a first inertial pressure. The hydraulic drive pump increases the pressure on the fluid moving from the hydraulic cylinder to the accumulator to a second pressure greater than the inertial pressure, and directs the fluid under the second pressure into the precharged fluid accumulator. Makeup or relief means in the pumping apparatus maintain the second pressure equal to the selected charge pressure. When the piston reaches its original first position, the hydraulic drive pump again reverses the flow of fluid and directs the flow from the precharged fluid accumulator to the hydraulic cylinder. The operational cycle thus begins anew.

The precharged fluid accumulator continuously recharges the hydraulic fluid for an indefinite period of time due to the constant transfer of energy between the inertial forces at the hydraulic cylinder and the precharge in the fluid accumulator. This constant transfer of force and energy through the hydraulic drive pump acts to reduce the load on the drive motor to those forces necessary to direct the flow of the fluid under pressure.

It is the primary object of this invention to provide an energy efficient, inexpensive means for pumping fluids.

Another object of this invention is to provide a pumping apparatus that is rapidly installed and easily maintained in the field.

Still another object of this invention is to provide an adjustable pumping apparatus which balances the forces directed to the drive motor.

Yet another object of this invention is to provide a pumping apparatus capable of infinitely variable pumping speeds and stroke lengths.

Yet still another object of this invention is to provide a pumping apparatus which can quickly and easily achieve and maintain a selected position for field set-up and maintenance.

Other objects and advantages of the invention will become apparent in the following detailed description of the preferred form thereof, reference being made to the accompanying drawings.

DESCRIPTION OF PREFERRED EMBODIMENT

Figure 3:
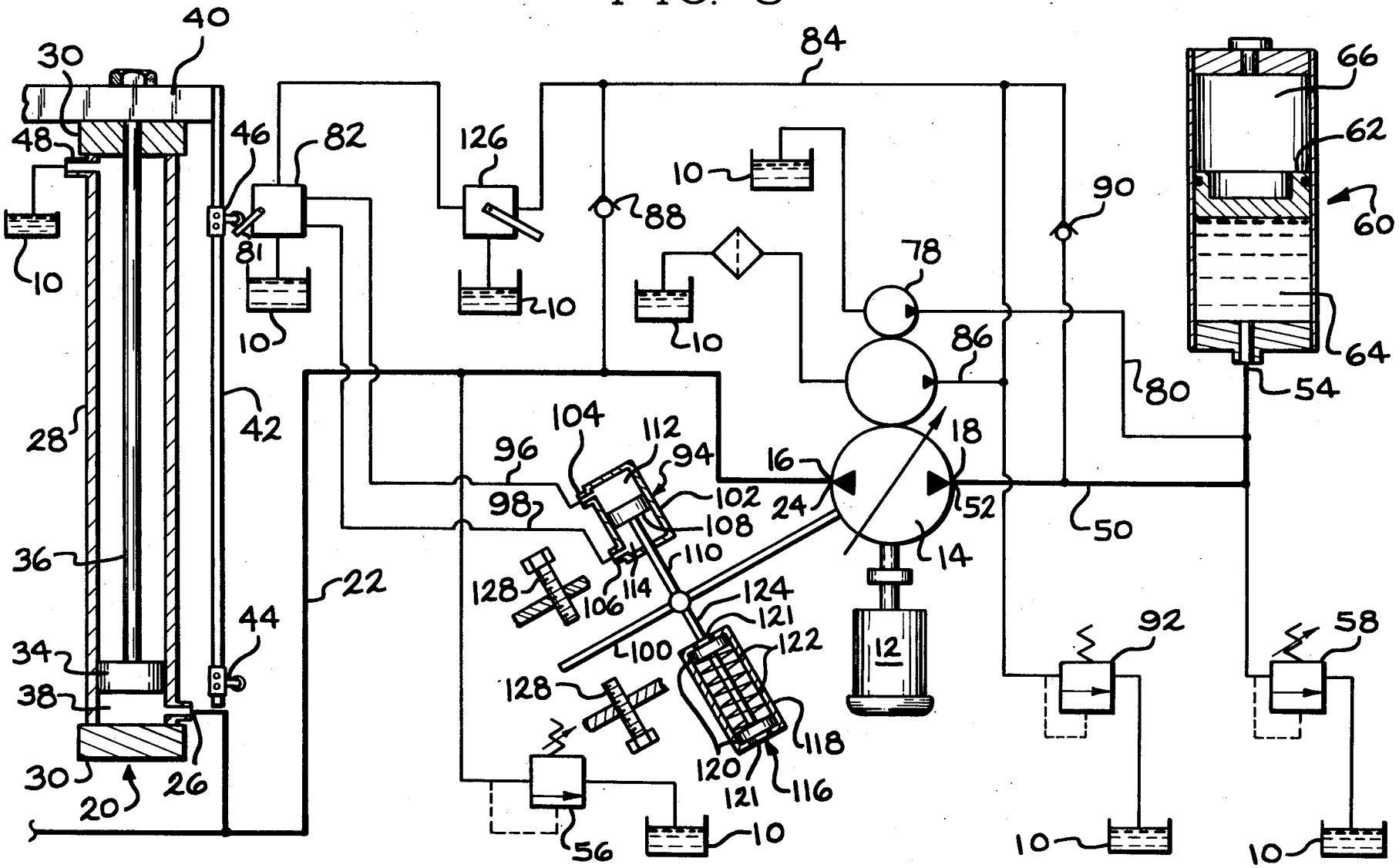
FIG. 3 is a detailed pictorial schematic of the hydraulic circuit of the present invention.
Figure 4:
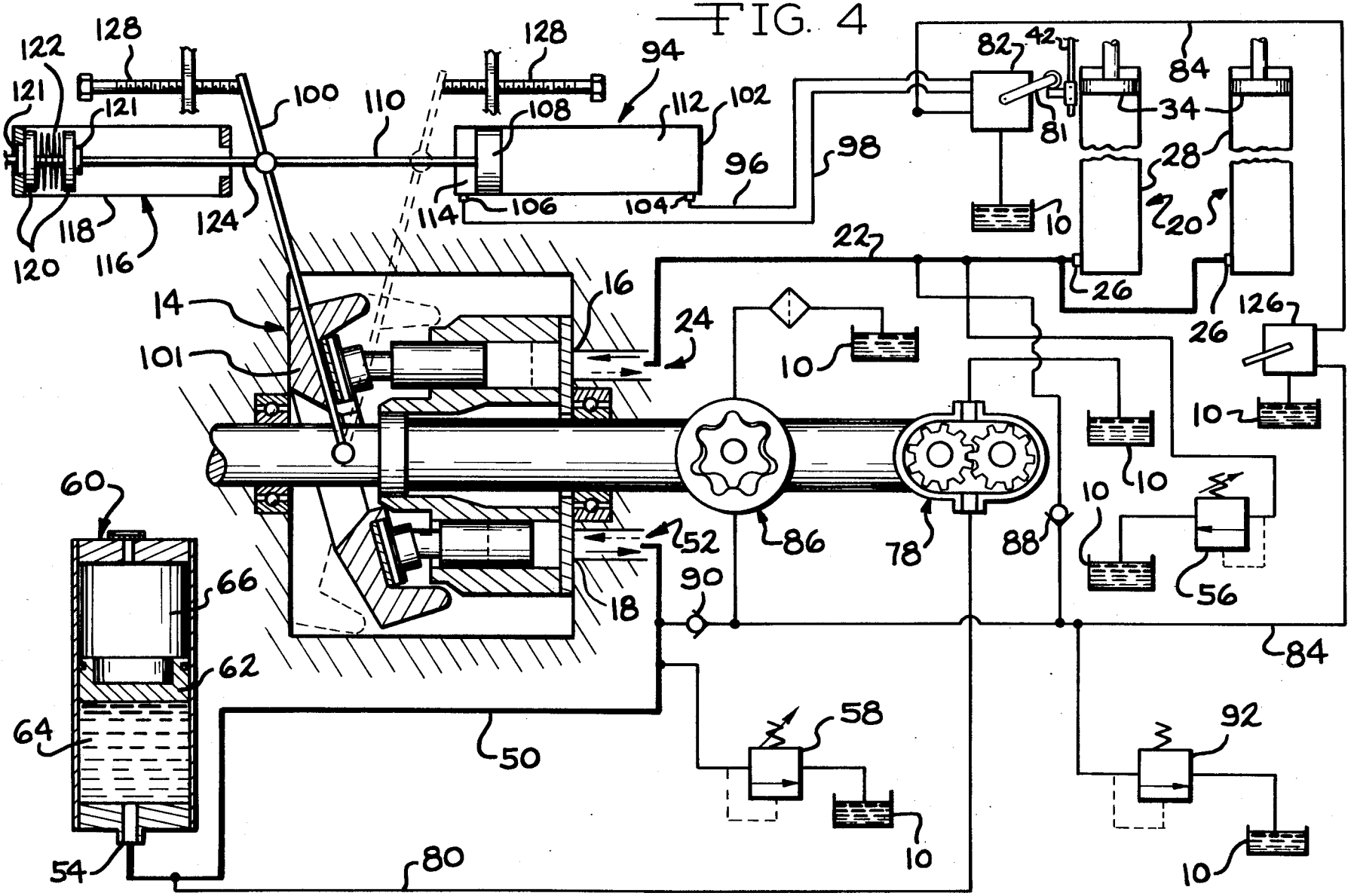
FIG. 4 is a detailed pictorial schematic of the hydraulic circuit of the present invention showing a cutaway view of the reversible variable displacement hydraulic drive pump.

As best shown in FIGS. 3 and 4, the preferred embodiment of the present invention comprises a pumping apparatus which balances the forces directed to the drive motor of a reversible, variable displacement hydraulic pump so that a relatively small, energy efficient drive motor can be utilized to pump fluid under high pressure. The pumping apparatus includes a fluid reservoir 10, a drive motor 12, and a reversible, variable displacement hydraulic drive pump 14. Two interconnected hydraulic pumping cylinders 20, each enclosing a piston 34, are operatively connected to a first port 16 of the hydraulic drive pump 14. A fluid accumulator 60 is operatively connected to the second port 18 of the hydraulic drive pump 14. The fluid accumulator 60 supplies fluid under a selected charge pressure to the hydraulic drive pump 14. The hydraulic drive pump 14, increasing the fluid pressure, directs the fluid under pressure to the hydraulic pumping cylinders 20. The fluid accumulator 60 is precharged to provide a selected charge pressure to the fluid and the hydraulic drive pump 14 increases the pressure on the fluid to a pressure necessary to drive the pistons 34 from a first position in a first direction to a second predetermined position.

This invention is particularly well suited in design for use with oil wells, and for the purpose of the description of the preferred embodiment, the present invention will be described as used in connection with an oil well. This description, however, is not intended to be limiting upon the breadth and scope of the disclosure and the claims which follow.

The reversible, variable displacement hydraulic drive pump 14 is preferably operated by a natural gas drive motor, however an electric drive motor can be used, if desired. A first main fluid conduit 22 is attached at one end 24 to the first port 16 of the hydraulic drive pump 14. The other end 26 of the first main fluid conduit 22 is connected to at least one hydraulic pumping cylinder 20.

Figure 1:
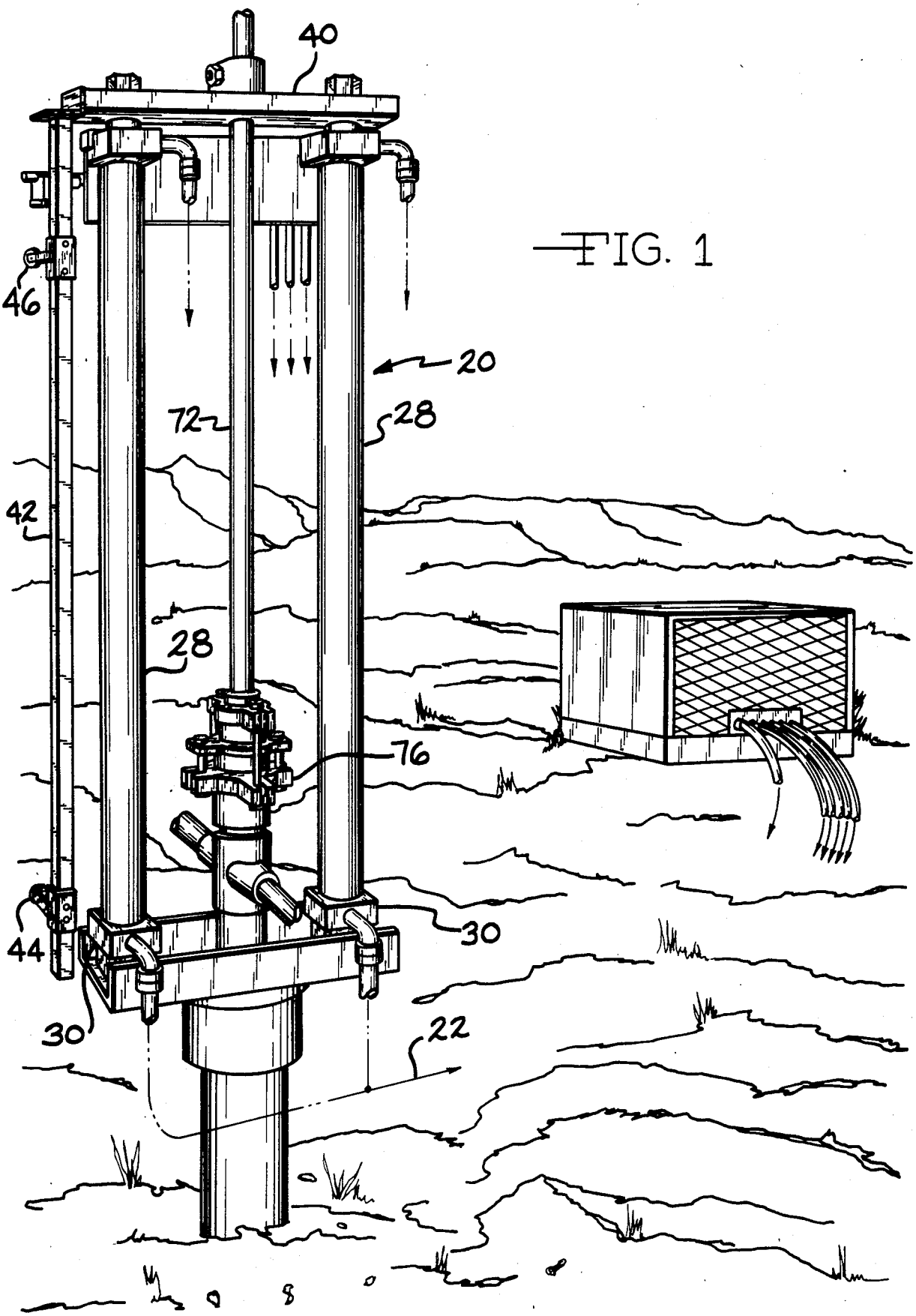
FIG. 1 is a perspective view of the present invention as installed.
Figure 2:
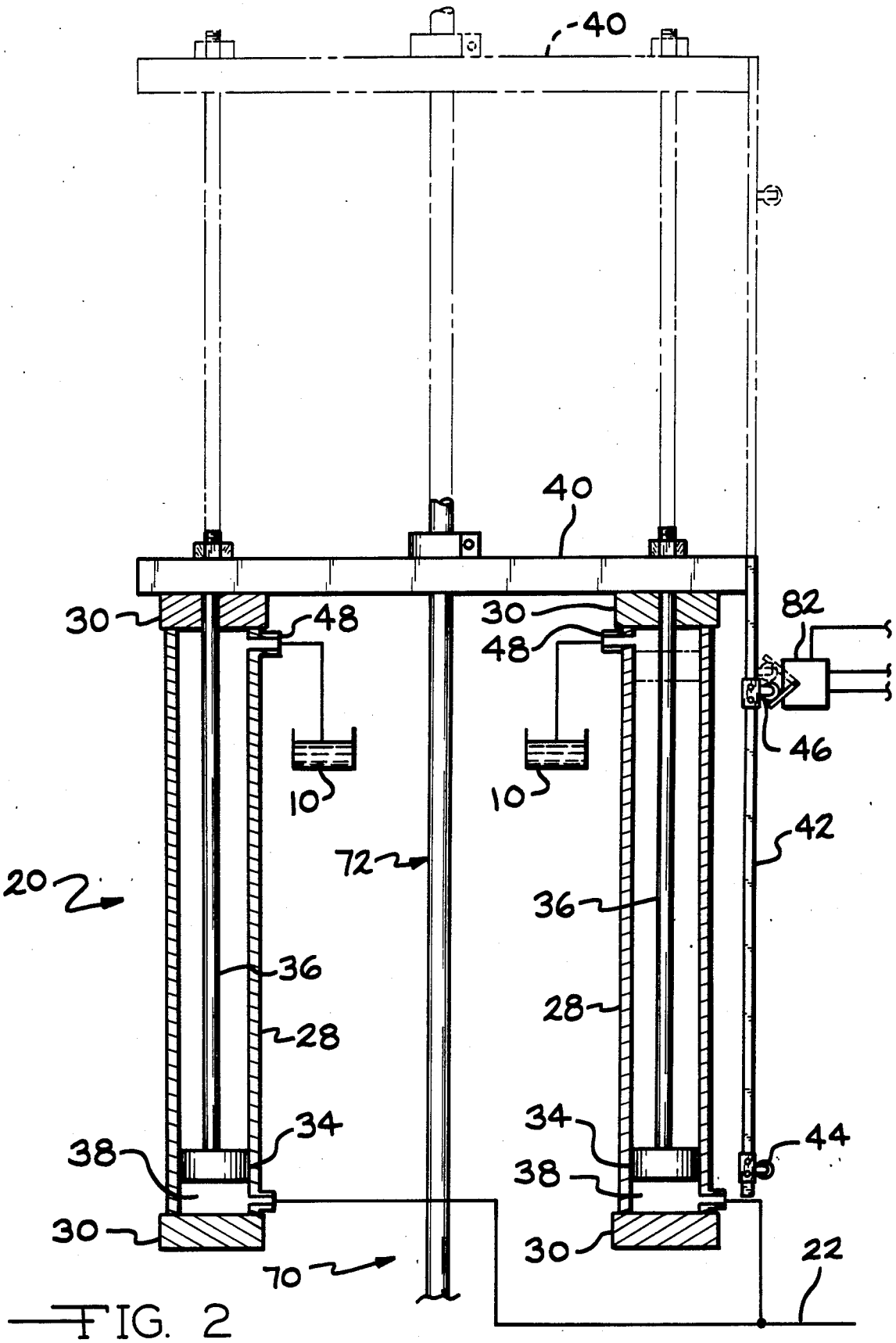
FIG. 2 is a detailed cutaway view of the hydraulic pumping cylinders of the present invention.

As shown in FIGS. 1 and 2 of the drawings, two interconnected hydraulic pumping cylinders 20, which operate in unison, are connected to the first main fluid conduit 22. However, any number of hydraulic pumping cylinders 20 can be used, depending upon individual design specifications. Each hydraulic pumping cylinder 20 has an outer casing 28 and the first main fluid conduit 22 connects to the outer casing 28 at a point adjacent to one end 30 of each cylinder 20. Piston 34 is positioned within the outer casing 28. A chamber 38 is defined in the outer casing 28 between the piston 34 and the end 30 of the outer casing. The first main fluid conduit 22 is in communication with the chamber 38. The piston rod 36 is connected to the piston 34 and extends the length of the outer casing 28, projecting through the other end 30 of the outer casing 28. Attached to the portion of the piston rod 36 extending beyond the outer casing 28 is a yoke plate 40. A drain 48 is also located at the other end 30 of the other casing 28. Any excess hydraulic fluid, which may seep past the piston 34, can be removed from the outer casing 28 through the drain 48 and returned to the fluid reservoir 10.

A control shaft 42, which is parallel to and extends the length of the piston rod 36 along the exterior of the outer casing 28, is attached to the yoke plate 40. A first adjustable control stop 44 and a second adjustable control stop 46 are attached to the control shaft 42. The first control stop 44 establishes the reversal point of the extension stroke of the piston rod 36. The second control stop 46 establishes the reversal point of the retraction stroke of the piston rod 36.

The yoke plate 40 is also connected to the polish rod portion 72 of the sucker rod apparatus 70. The polish rod 72 is that portion of the sucker rod apparatus 70 which is polished to smoothly slide through the well-head packing 76 as the oil pump is operated. The sucker rod portion (not shown) of the sucker rod apparatus 70 extends the length of the interior of the well from the polish rod 72 to the oil pump (not shown). As the piston rod 36 extends and retracts, the yoke plate 40 will likewise cause the polish rod 72 to extend and retract through the well-head packing 76, thus operating the oil pump.

Referring to FIGS. 3 and 4, a second main fluid conduit 50 is connected at one end 52 to the second port 18 of the hydraulic drive pump 14. The other end 54 of the second main fluid conduit 50 is connected to the pressurized fluid accumulator 60. The fluid accumulator 60 has a movable barrier 62 which creates a fluid chamber 64 and a gas chamber 66. The gas chamber 66 is precharged, for example, by means of nitrogen cartridge, to a preselected charge pressure which provides a majority of the fluid pressure necessary to operate the hydraulic pumping cylinder 20 in lifting the sucker rod apparatus 70 and column of crude oil.

The first main fluid conduit 22 includes a safety relief valve 56 which discharges the fluid under pressure to the fluid reservoir 10 should the pressure between the hydraulic drive pump 14 and the hydraulic pumping cylinder 20 exceed a predetermined level. A pressure control valve 58 is located in the second main fluid conduit 50 between the fluid accumulator 60 and the hydraulic drive pump 14. The pressure control valve 58 is preset in the "field" by the operator to maintain the pressure level in the second main fluid conduit 50 and fluid accumulator 60 at an established level.

A high pressure replenishing pump 78 is integrally connected in combination with the hydraulic drive pump 14 and is driven by the drive motor 12. The high pressure replenishing pump 78 directs fluid through a replenishing line 80 to the second main fluid conduit 50 at a point adjacent the fluid accumulator 60. The high pressure replenishing pump 78 is a small displacement pump which continuously injects small amounts of hydraulic fluid into the second main fluid conduit 50 to compensate for any fluid loss in the pumping circuit due to internal leakage in the components of the pumping circuit. The pressure control valve 58 will discharge any excess hydraulic fluid in the second main fluid conduit 50, when the high pressure replenishing pump 78 supplies enough fluid to cause the pressure in the second main fluid conduit 50 to increase above the preset control pressure.

As shown in FIGS. 3 and 4, a control circuit is operatively integrated into the main pumping circuit. The control circuit consists of a pilot control valve 82 which is connected by a pilot fluid line 84 to the first 22 and second 50 main fluid conduits. A low pressure charging pump 86, an integral part of the hydraulic drive pump 14, is connected to the pilot fluid line 84 to maintain pilot fluid pressure within the pilot fluid line 84. The pilot fluid line 84 includes a first check valve 88 located adjacent the first main fluid conduit 22 and a second check valve 90 located adjacent the second main fluid conduit 50. Should the pressure in either main fluid conduit become less than the pressure in the pilot fluid line 84, the pilot fluid supplied by the low pressure charging pump 86 is diverted through the first check valve 88 to the first main fluid conduit 22 or the second check valve 90 to the second main fluid conduit 50. The low pressure charging pump 86 will return the pilot fluid to the fluid reservoir 10 through valve 92 when the pilot fluid line 84 and first 22 and second 50 main fluid conduits exceed the pre-established pressure setting of the valve 92.

The pilot control valve 82 is connected by a first alternate control line 96 and a second alternate control line 98 to a hydraulic control cylinder 94. The hydraulic control cylinder 94 is operatively connected to the control lever 100 of the hydraulic drive pump 14. The control lever 100 is operatively fixed to the swash plate 101 within the hydraulic drive pump 14. The hydraulic control cylinder 94 has an outer casing 102 having a first port 104 and a second port 106. The first alternate control line 96 is connected to the first port 104 and the second alternate control line 98 is connected to the second port 106. Within the outer casing 102 is a piston 108. The piston 108 divides the outer casing 102 so that the first port 104 and second port 106 are on opposed sides of the piston 108. A piston rod 110 extends from the piston 108 through one end of the outer casing 102 and connects with the control lever 100 of the hydraulic drive pump 14.

The control arm 81 of the pilot control valve 82 is engaged by the first adjustable control stop 44 when the piston 34 and piston rod 36 of the hydraulic pumping cylinder 20 are in the fully extended position. The control arm 81 in this position will cause the pilot control valve 82 to direct pilot fluid into the first alternate control line 96. The pilot fluid enters the first port 104 of the outer casing 102 of the hydraulic control cylinder 94, causing the first chamber 112 to fill. As the first chamber 112 fills with fluid, the piston 108, piston rod 110 and control lever 100 are displaced to tilt the swash plate 101 of the hydraulic drive pump 14 and reverse the flow of fluid through the hydraulic drive pump 14. As the fluids flows from the hydraulic pumping cylinder 20 to the fluid accumulator 60 the piston 34 and piston rod 36 will retract. When the piston 34 and piston rod 36 are in the fully retracted position, the control arm 81 of the pilot control valve 82 is engaged by the second adjustable control stop 46. The control arm 81 in this position will cause the pilot control valve 82 to direct pilot fluid into the second alternate control line 98. The pilot fluid enters the second port 106 of the outer casing 102 of the hydraulic control cylinder 94, causing the second chamber 114 to fill. As the second chamber 114 fills, the piston 108 will move, forcing the pilot fluid in the first chamber 112 to flow out of the first chamber 112. The moving piston 108 and piston rod 110 displaces the control lever 100 to tilt the swash plate 101 of the hydraulic drive pump 14 and reverse the flow of the hydraulic fluid, thereby causing the fluid to flow to the hydraulic pumping cylinder 20. The flow of fluid to the hydraulic pumping cylinder 20 causes the piston 34 and piston rod 36 to extend, thus completing the pumping cycle.

A biasing means 116 is fixed to the control lever 100 of the hydraulic drive pump 14 and is opposed to the hydraulic control cylinder 94. The biasing means 116 has an outer casing 118 with a spring 122 positioned within the outer casing 118. Plates 120 are located at each end of the spring 122, adjacent the ends of the outer casing 118. A rod 124 extends through the spring 122 and the two plates 120, so that the two plates 120 are free to slide on the rod 124. Stops 121, located adjacent the plates 120, limit the movement of the plates 120 on the rod 124. The end of the rod 124 extending through the outer casing 118 is connected to the control lever 100. As the hydraulic control cylinder 94 displaces the control lever 100, the rod 124 moves one of the plates 120 of the biasing means 116 against the spring 122. When the forces exerted by the hydraulic control cylinder 94 are less than the force of the spring 122, the biasing means 116 will return the control lever 100 to a predetermined position.

A manual override valve 126 is located in the pilot fluid line 84. The manual override valve 126 has two operative positions. When the manual override valve 126 is in the first position, the pilot fluid flows through the manual override valve 126 to the pilot control valve 82 where it is directed into the first 96 or second 98 alternate control line. When in the second position, the manual override valve 126 blocks the flow of pilot fluid. The pilot fluid remaining in the pilot control valve 82, the first 96 and second 98 alternate control lines, and the hydraulic control cylinder 94 will drain through the manual override valve 126 to the fluid reservoir 10, thereby eliminating the pilot pressure at the hydraulic control cylinder 94. When the manual override valve 126, is in this second position, the pretensioned biasing means 116 overcomes the forces of the hydraulic control cylinder 94. The control lever 100 can then be manually displaced as desired to cause the hydraulic pumping cylinders 20 to maintain and hold any given position thereby facilitating set up and maintenance at the well-head.

The displacement of the hydraulic drive pump 14 is controlled by adjustable stops 128 positioned on opposed sides of the control lever 100. These adjustable stops 128 are set at an established position to operate the hydraulic drive pump 14 at a predetermined displacement, thereby controlling the rate of fluid flow through the hydraulic drive pump 14 and controlling the speed with which the pistons 34 of the hydraulic pumping cylinders 20 extend and retract.

The fluid accumulator gas chamber 66 is precharged to a preselected pressure equalling approximately the pressure created by the inertial weight of the sucker rod apparatus 70 and the column of crude oil acting on the piston surface area of the hydraulic pumping cylinder 20. As the hydraulic drive pump 14 and drive motor 12 are operated to extend the piston rod 36 of the hydraulic pumping cylinder 20 the precharged fluid in the fluid accumulator 60 will provide assistance. The charge pressure of the fluid created by the precharge in the fluid accumulator 60 is increased as the fluid is driven by the hydraulic drive pump 14. This increased fluid pressure works on the piston 34 surface area to overcome the inertial forces of the sucker rod apparatus 70 and column of crude oil to drive the piston 34 and piston rod 36 to the extended position. This unique counterbalance system results in an energy efficient design that allows a low-energy small drive motor to operate the pumping circuit and hydraulic pumping cylinder under very high pressures.

The hydraulic pumping system of the present invention operates as follows. The hydraulic fluid is pressurized to a preselected charge pressure in the fluid accumulator 60 and is driven by the hydraulic drive pump 14 to the hydraulic pumping cylinder 20. The hydraulic drive pump increases the pressure on the fluid to a working pressure required to drive the piston 34 of the hydraulic pumping cylinder 20. The force of the working pressure (the sum of the precharge pressure plus the cumulative pump pressure) at the piston 34 will overcome the inertial forces of the sucker rod apparatus 72 and column of oil and the piston rod 36 will extend out of the outer casing 28 to a predetermined position. The predetermined extension of the piston rod 36 will pull the polish rod 72 portion of the sucker rod apparatus 70 from the well-head 76 since the piston rod 36 and polish rod 72 are fixed together by the yoke plate 40. The predetermined extension of the polish rod 72 and remaining sucker rod apparatus 70 causes the crude oil to be pumped from the well. When the piston rod 36 has extended to the predetermined point, the first adjustable control stop 44 on the control shaft 42 will engage the control arm 81 of the pilot control valve 82. As the first adjustable stop 44 engages the control arm 81, the pilot control valve 82 directs fluid through the first alternate control line 96 to the hydraulic control cylinder 94. The fluid displaces the piston 108 in the control cylinder 94, causing the piston rod 110 to displace the control lever 100 of the hydraulic drive pump 14, thereby tilting the swash plate 101 within the hydraulic drive pump 14.

The tilting of the swash plate 101 reverses the direction of fluid flow through the hydraulic drive pump 14. The reverse flow of fluid through the hydraulic drive pump 14 retracts the piston 34 of the hydraulic cylinder 20 back into the hydraulic cylinder 20 and directs the fluid to the fluid accumulator 60. The inertial weight of the sucker rod apparatus 70 and column of crude oil directed to the hydraulic pumping cylinder 20, acts on the surface area of the piston 34 in the hydraulic pumping cylinder 20 to pressurize the hydraulic fluid to a first inertial pressure. The inertial pressure of the hydraulic fluid is increased as the fluid is driven by the hydraulic drive pump 14 to a second pressure which compresses the precharged gas chamber 66 in the fluid accumulator 60. Thus, the energy created by the retraction of the hydraulic pumping cylinder 20 under the inertial forces exerted by the sucker rod apparatus 70 and column of crude oil is transferred to the precharged fluid accumulator 60. This energy is stored in the fluid accumulator 60 until the hydraulic pumping cylinder 20 begins its extension stroke.

When the piston rod 36 has retracted to a predetermined point, the second adjustable control stop 46 on the control shaft 42 will engage the control arm 81 of the pilot control valve 82. As the second adjustable control stop 46 engages the control arm 81, the pilot control valve 82 directs fluid through the second alternate control line 98 to the hydraulic control cylinder 94. The fluid displaces the piston 108 in the control cylinder 94, causing the piston rod 110 to displace the control lever 100 of the hydraulic drive pump 14, thereby tilting the swash plate 101 within the hydraulic drive pump 14. As the swash plate 101 is tilted, the fluid flow reverses to flow from the precharged fluid accumulator 60 to the hydraulic pumping cylinder 20 to begin the above-described pumping cycle again. During the extension stroke the stored energy from the retraction stroke will be transferred, as previously described, back to the hydraulic pumping cylinder 20 to assist the hydraulic drive pump 14 in lifting the sucker rod apparatus 70 and column of crude oil.

Referring now to FIG. 4, the fluid flow through the variable displacement pump as function of the position of the swash plate 101 is seen. As the swash plate 101 is tilted in response to the hydraulic control cylinder 94, the displacement of the hydraulic drive pump 14 is smoothly reduced from a maximum in one direction to zero to a maximum in the reverse direction, in a very short time. The smooth deflection of the swash plate 101 creates a smooth reversal of stroke at the hydraulic pumping cylinder 20. This smooth shift eliminates the jerking reversal problems associated with the use of a fixed displacement pump.

Should the pressure in the first main fluid conduit 22, hydraulic pumping cylinder 20, or hydraulic drive pump 14 reach a level where the pumping circuit is in danger of overloading, the safety relief valve 56, located in the first main fluid conduit 22, will open. The opening of the safety relief valve 56 returns the hydraulic fluid to the fluid reservoir 10, thereby preventing potential high pressure failure of the pumping circuit.

The pressure control valve 58 located in the second main fluid conduit 50 will likewise return hydraulic fluid to the fluid reservoir 10 when the pressure of the fluid in the fluid accumulator 60, the second main fluid conduit 50, or hydraulic drive pump 14 reaches a preset pressure. It is advantageous to maintain the charge pressure value of the fluid in the fluid accumulator 60 and second main fluid conduit 50 to that level necessary to effectively counterbalance the inertial forces exerted on the hydraulic pumping cylinder 20. The pressure control valve 58 is utilized in the "field" to fine tune and preset the charge pressure of the fluid to the most balanced mode. Such equivalance between the charged fluid as driven by the hydraulic drive pump 14 to the hydraulic pumping cylinder 20 and the inertial forces exerted by the sucker rod apparatus 70 and column of crude oil will optimize the mechanical load on the drive motor 12 so that the drive motor 12 will work equally hard on the extension stroke as the retraction stroke.

Hydraulic pumping circuits, such as the present invention, have a certain amount of internal leakage and the hydraulic driving fluid must be replenished. The high pressure replenishing pump 78 is deliberately sized to have a slightly greater displacement than the internal leakage which may occur. This excess displacement causes additional hydraulic fluid to be delivered to the fluid accumulator 60, compressing the precharged gas chamber 66 in the fluid accumulator 60 and increasing the internal fluid pressure in the fluid accumulator 60. The high pressure replenishing pump 78 is in continual operation as it is integrally connected to the drive mechanism of the hydraulic drive pump 14. The continual operation of the high pressure replenishing pump 78 provides a continual supply of excess hydraulic fluid to the fluid accumulator 60. In normal operation, when the differential fluid pressure in the fluid accumulator 60 substantially equalizes the forces exerted on the drive motor 12, a very small amount of hydraulic fluid is discharged with each cycle through the pressure control valve 58, thereby maintaining the internal fluid pressure of the fluid accumulator 60 at the optimum level.

As previously indicated, the low pressure charging pump 86 will maintain the pilot fluid pressure in the pilot fluid line 84 and control circuit. The valve 92 of the low pressure charging pump 86 establishes the pressure level within the pilot fluid line 84. Whenever the pressure level in the pilot fluid line 84 exceeds the pressure value at the valve 92, the pilot fluid will be returned to the fluid reservoir 10 through the valve 92. The valve 92 will remain open until the pressure level in the pilot fluid line 84 drops below the preset pressure value of the valve 92.

The valve 92 is also utilized to assist in the prevention of unwanted cavitation by the hydraulic drive pump 14. Should the pressure in the first main fluid conduit 22 drop below the pressure value of the valve 92, the check valve 88 contained in the pilot fluid line 84, adjacent the first main fluid line 22, will open. Fluid delivered by the low pressure charging pump 86 is diverted through the check valve 88 into the first main fluid conduit 22. This diversion of fluid will continue until the pressure in the first main fluid conduit 22, exceeds the pressure value of the valve 92. When the pressure in the first main fluid conduit 22 exceeds the preset pressure value of the valve 92, the valve 92 will open and the check valve 88 will close. The valve 92 will remain open until the pressure in the pilot fluid line 84 drops below the preset pressure value of the valve 92. The valve 92 will then close and the low pressure charging pump 86 will direct fluid to the pilot fluid line 84 as described above. Should the pressure in the second main fluid conduit 50 drop below the pressure value of the valve 92, the check valve 90 contained in the pilot fluid line 84, adjacent the second main fluid conduit 50, will open. Fluid delivered by the low pressure charging pump 86 is diverted through the check valve 90 into the second main fluid conduit 50. This diversion of fluid will continue until the pressure in the second main fluid conduit 50 exceeds the pressure value of the valve 92. When the pressure in the second main fluid conduit 50 exceeds the preset pressure value of the valve 92, the valve 92 will open and the check valve 90 will close. The valve 92 will remain open until the pressure in the pilot fluid line 84 drops below the preset pressure value of the valve 92. The valve 92 will then close and the low pressure charging pump 86 will direct fluid to the pilot fluid line 84 as described above.

The hydraulic drive pump 14 will leak fluid when exposed to high pressure from the first 22 and second 50 main fluid conduits. This leakage will occur, with or without the drive motor 12 running, as long as there is pressurized fluid in the first 22 and second 50 main fluid conduits. Therefore, after the drive motor 12 has been shut off, the high pressure hydraulic fluid stored in the fluid accumulator 60 will leak off until the precharged gas chamber 66 is fully extended and there is no more hydraulic fluid under pressure in the fluid accumulator 60 or second main fluid conduit 50. Likewise, the hydraulic pumping cylinder 20 will slowly retract due to the constant inertial force exerted by the weight of the sucker rod apparatus 70 and column of crude oil, causing the hydraulic fluid in the first fluid conduit 22 to leak from the hydraulic drive pump 14. Eventually, the pressures in the first 22 and second 50 main fluid conduits will become negligible. Since the piston 34 of the hydraulic pumping cylinder 20 is fully retracted, the pilot control valve 82 is in the position to direct pilot fluid to the hydraulic control cylinder 94 to displace the control lever 100 of the hydraulic drive pump 14, tilting the swash plate 101 and causing the hydraulic fluid to flow to the hydraulic pumping cylinder 20 to extend the piston rod 36.

On the first stroke of startup, the drive motor 12 does not have sufficient power to extend the piston rod 36 of the hydraulic pumping cylinder 20 and lift the inertial weight of the sucker rod apparatus 70 and column of crude oil at the normal pumping rate. The counterbalance pressure from the precharged fluid accumulator 60 in the second main fluid conduit 50 is negligible since the hydraulic fluid has leaked away during shutdown. Without the hydraulic fluid under pressure from the fluid accumulator 60, the hydraulic drive pump 14 will normally cavitate upon startup at full displacement. Due to the low pressure in the second main fluid conduit 50, the check valve 90 will open, directing fluid from the low pressure charging pump 86 through check valve 90 to the second main fluid conduit 50, thereby preventing cavitation of the hydraulic drive pump 14. The low pressure charging pump 86 will displace its entire volume of pumped fluid into the second main fluid conduit 50 due to the negligible amount of existing fluid under pressure in the second main fluid conduit 50. It can be seen, therefore, that the displacement of the hydraulic drive pump 14 will become equal to the displacement of the low pressure charging pump 86, during this initial stroke.

The diversion of the pilot fluid from the low pressure charging pump 86 to the second main fluid conduit 50 causes the pressure in the pilot fluid line 84 to fall below the pressure value of the valve 92, thereby closing valve 92. The pressure in the pilot fluid line 84 and the pressure in the second main fluid conduit 50 will be equal, since the check valve 90 is open, during startup. Since the pilot pressure is low, the pressure at the pilot control valve 82, first alternate control line 96, second alternate control line 98 and hydraulic control cylinder 94 will also be lower than normal. The low pressure will act to move the hydraulic control cylinder 94 a small distance in opposition to the biasing means 116. The control lever 100 will, as a result, be displaced a small amount causing the swash plate 101 to be displaced less than during the conventional operating mode. As the swash plate 101 is displaced, it will cause the displacement of the hydraulic drive pump 14 to equal the displacement of the low pressure charging pump 86.

In the present invention, the maximum displacement of the low pressure charging pump 86 is approximately one-fifth the normal displacement of the hydraulic pump drive 14. Since the displacement of the hydraulic drive pump 14 is reduced to approximately one-fifth its maximum displacement, the hydraulic pumping cylinder 20 will extend at approximately one-fifth its normal rate, thereby reducing the torque load on the drive motor 12. Therefore, the drive motor 12 is capable of supplying sufficient power to extend the hydraulic pumping cylinder 20 on the first stroke without stalling.

Once the piston rod 36 becomes fully extended the first adjustable control stop 44 engages the pilot control valve 82 causing the flow of fluid from the hydraulic drive pump 14 to be reversed in the manner discussed earlier herein. The inertial forces of the sucker rod apparatus 70 and column of crude oil will force the piston rod 36 to retract as the hydraulic fluid is withdrawn from the hydraulic pumping cylinder 20. The forces exerted by the sucker rod apparatus 70 and column of crude oil on the hydraulic pumping cylinder 20 will be transferred to the fluid accumulator 60 through the hydraulic fluid and stored in the fluid accumulator 60 by compression of the precharged gas chamber 66. Therefore, once full retraction of the piston rod 36 of the hydraulic pumping cylinder 20 is completed and the second adjustable control stop 46 contacts the pilot control valve 82 reversing the flow of the hydraulic drive pump 14, the fluid accumulator 60 is usually precharged sufficiently to begin the normal pumping cycle as described in detail above.

Of course, depending on the specific needs of each well, different variable displacement hydraulic drive pumps may be found to be more efficient. In a common variation of this preferred embodiment the biasing means 116 and the hydraulic control cylinder 94 are included as integral parts of the hydraulic drive pump 14, thereby eliminating possible mechanical problems associated with certain applications.

It will be appreciated that other arrangements of the pumping apparatus may be used and that changes may be made in the elements of the pumping apparatus without departing from the scope of the following claims.

What I claim is:

1. A reciprocating apparatus for use in pumping wells having well-head apparatus including a polish rod comprising, in combination:

precharged means for applying a precharge pressure to a fluid;

first pumping means for pumping the fluid and adding a cumulative pressure to and above the precharge presure in communication with said precharge means;

cylinder means in communication with said pumping means for receiving a working presure which includes the precharge pressure applied by said precharge means and the cumulative pressure applied by said pumping means, said cylinder means being adapted to operatively connect with the polish rod supporting a mass withn the well, whereby such working pressure applies a working force to said cylinder means to move th polish rod supporting the mass;

pilot means for reversing the fluid flow away from said cylinder means to said precharge means, the mass applying a recharging pressure to the reversed fluid as the reversed fluid flows from said cylinder means to said pumping means, said pumping means applying a second cumulative pressure to said recharging pressure, whereby said precharge means receives a pressure which includes said recharging pressure said second cumulative pressure; and, said pilot means including second pump means operatively connected to said first pumping means for substantially eliminating any unexpected cavitation of said first pumping means.

2. The reciprocating apparatus of claim 1, wherein said cylinder means includes at least two hydraulic cylinders operatively connected together in parallel, said connected hydraulic cylinders being adapted to be fixed directly to the well-head apparatus.

3. The reciprocating apparatus of claim 2, wherein each of said hydraulic cylinders includes an individual piston means, said individual piston means of said hydraulic cylinders being operatively connected together and adapted to operatively connect with the polish rod supporting the mass, whereby said connected piston means receive a working force from the fluid under a working pressure from said precharge means and said first pumping means, thereby moving the polish rod supporting the mass from a first position in a first direction to a second predetermined position.

4. The reciprocating apparatus of claim 3 wherein said pilot means includes a control means for controlling the direction of fluid flow through said first pumping means in response to the position of said connected piston means, wherein said control means directs the first pumping means to pump the fluid flow from said precharge means to said cylinder means to move said piston means from the first position to the second predetermined position and wherein said control means also directs said pumping means to reverse the direction of fluid flow when said piston means reaches the second predetermined position, whereby the fluid is pumped from said cylinder means to said precharged means causing the piston means to retract from the second predetermined position to the first position.

5. The reciprocating apparatus of claim 4 wherein said control means further controls the displacement of said first pumping means, thereby controlling the rate with which said connected piston means of said cylinder means moves the polish rod supporting the mass.

6. The reciprocating apparatus of claim 5 wherein said control means includes means for moving said connected piston means of said cylinder means and the polish rod supporting the mass to a desired position and maintaining that desired position without fluctuation for a predetermined time period.

7. The reciprocating apparatus of claim 5 wherein said second pumping means is operatively connected to said first pumping means for supplying fluid under pressure to said control means.

8. The reciprocating apparatus of claim 7, wherein said first pumping means includes an intake side and said second pumping means also supplies fluid to the intake side of said first pumping means when the fluid flow to said first pumping means from said precharge means or said cylinder means is reduced to a level that said first pumping means tends to cavitate, whereby the fluid received from said second pumping means prevents said first pumping means from cavitating and the displacement of said first pumping means becomes substantially equal to the displacement of said second pumping means.

9. The reciprocating apparatus of claim 8 further including a pressure control means located between said precharge means and said first pumping means for maintaining the pressure between said precharge means and said first pumping means at the desired precharge pressure during normal operation.

10. The reciprocating apparatus of claim 9 wherein said pressure control means includes a third pumping means operatively connected to said first pumping means, wherein said third pumping means adds fluid to said precharge means to make up for fluid lose.

11. The reciprocating apparatus of claim 10 wherein said pressure control means further includes relief means for eliminating fluid from said precharge means for maintaining said precharge pressure.

12. A pumping apparatus for use in pumping wells having a well-head apparatus including a polish rod supporting a mass within such well comprising in combination:

a precharged accumulator means for applying a precharge pressure to a fluid;

first pumping means for pumping the fluid and adding a cumulative pressure to and above the precharge pressure in communication with said accumulator;

cylinder means in communication with said first pumping means, said cylinder means including at least two hydraulic cylinders adapted to be fixed directly the well head apparatus, each of said hydraulic cylinders including a individual piston means, said individual piston means of said hydraulic cylinders being connected together and adapted to operatively connected with the polish rod, whereby said connected piston means receive a working force from a working pressure which includes the precharge presure applied by said accumulator and the cumulative pressure applied by aid first pumping means, whereby the working force moves the polish rod from a first position in a first direction to a second predetermined position;

means for reversing the fluid flow away from said cylinder means to said accumulator and reversing means including a pilot control means, said pilot control means controlling the direction of fluid flow through said first pumping means in response to the position of said connected piston means, wherein said pilot control means directs the first pumping means to pump the fluid flow from said accumulator to said cylinder means to moves said piston means from a first position to a second predetermined position and said pilot means directs said pumping means to reverse the direction of fluid flow when said piston means reaches the second predetermined position whereby the fluid flow from said cylinder means to said accumulator and the mass applies a recharging pressure to the reversed fluid as the fluid flows from said cylinder means to said first pumping means, said first pumping means applies a second cumulative pressure to said recharging pressure, whereby said accumulator receives a pressure which includes said recharging pressure and said second cumulative pressure as said piston means retracts from the second predetermined position to the first position;

a second pumping means operatively connected to said first pumping means for supplying fluid under pressure to said pilot control means, said second pumping means also supplying fluid to the intake side of said first pumping means when the fluid flowing through said first pumping means from said accumulator or said cylinder means is reduced to a level that said first pumping means tends to cavitate, whereby the fluid received from said second pumping means prevents said first pumping means from cavitating and the displacement of said first pumping means becomes substantially equal to the displacement of said second pumping means.

* * * * *